US006974372B1

(12) United States Patent
Muldowney

(10) Patent No.: US 6,974,372 B1
(45) Date of Patent: Dec. 13, 2005

(54) POLISHING PAD HAVING GROOVES CONFIGURED TO PROMOTE MIXING WAKES DURING POLISHING

(75) Inventor: Gregory P. Muldowney, Earleville, MD (US)

(73) Assignee: Rohm and Haas Electronic Materials CMP Holdings, Inc., Wilmington, DE (US)

( * ) Notice: Subject to any disclaimer, the term of this patent is extended or adjusted under 35 U.S.C. 154(b) by 0 days.

(21) Appl. No.: 10/869,394

(22) Filed: Jun. 16, 2004

(51) Int. Cl.[7] ..... B24D 11/00
(52) U.S. Cl. ..... 451/527; 451/921
(58) Field of Search ..... 451/41, 59, 526, 451/527, 529, 533, 539, 550, 921

(56) References Cited

U.S. PATENT DOCUMENTS 5,690,540 A * 11/1997 Elliott et al. ..... 451/41
5,921,855 A 7/1999 Osterheld et al.
5,990,012 A 11/1999 Robinson et al.
6,159,088 A 12/2000 Nakajima
6,273,806 B1 8/2001 Bennett et al.
6,315,857 B1 11/2001 Cheng et al.
6,354,919 B2 3/2002 Chopra
6,520,847 B2 2/2003 Osterheld et al.
6,685,548 B2 * 2/2004 Chen et al. ..... 451/526
6,783,436 B1 * 8/2004 Muldowney ..... 451/41
6,843,709 B1 * 1/2005 Crkvenac et al. ..... 451/41
6,843,711 B1 * 1/2005 Muldowney ..... 451/527

FOREIGN PATENT DOCUMENTS

KR 2002-0022198 A 3/2002

* cited by examiner

*Primary Examiner*—Dung Van Nguyen
(74) *Attorney, Agent, or Firm*—Blake T. Biederman

(57) ABSTRACT

A polishing pad (104, 300, 400, 500) for polishing a wafer (112, 516), or other article. The polishing pad includes a polishing layer (108) containing a plurality of grooves ((148, 152, 156)(304, 308, 324)(404, 408, 424)(520, 524, 528)) having orientations largely parallel to one or more corresponding respective velocity vectors (V1–V4)(V1'–V4')(V1"–V4")(V1'"–V4'") of the wafer. These parallel orientations promote the formation of mixing wakes in a polishing medium (120) within these grooves during polishing.

10 Claims, 3 Drawing Sheets

POLISHING PAD HAVING GROOVES CONFIGURED TO PROMOTE MIXING WAKES DURING POLISHING

BACKGROUND OF THE INVENTION

The present invention generally relates to the field of polishing. In particular, the present invention is directed to a polishing pad having grooves configured to enhance or promote mixing wakes during polishing.

In the fabrication of integrated circuits and other electronic devices, multiple layers of conducting, semiconducting and dielectric materials are deposited onto and etched from a surface of a semiconductor wafer. Thin layers of these materials may be deposited using any of a number of deposition techniques. Deposition techniques common in modern wafer processing include physical vapor deposition (PVD), also known as sputtering, chemical vapor deposition (CVD), plasma-enhanced chemical vapor deposition (PECVD) and electrochemical plating. Common etching techniques include wet and dry isotropic and anisotropic etching, among others.

As layers of materials are sequentially deposited and etched, the uppermost surface of the wafer becomes non-planar. Because subsequent semiconductor processing (e.g., photolithography) requires the wafer to have a flat surface, the wafer needs to be planarized. Planarization is useful for removing undesired surface topography as well as surface defects, such as rough surfaces, agglomerated materials, crystal lattice damage, scratches and contaminated layers or materials.

Chemical mechanical planarization, or chemical mechanical polishing (CMP), is a common technique used to planarize workpieces, such as semiconductor wafers. In conventional CMP using a dual-axis rotary polisher, a wafer carrier, or polishing head, is mounted on a carrier assembly. The polishing head holds the wafer and positions it in contact with a polishing layer of a polishing pad within the polisher. The polishing pad has a diameter greater than twice the diameter of the wafer being planarized. During polishing, each of the polishing pad and wafer is rotated about its respective center while the wafer is engaged with the polishing layer. The rotational axis of the wafer is offset relative to the rotational axis of the polishing pad by a distance greater than the radius of the wafer such that the rotation of the pad sweeps out a ring-shaped "wafer track" on the polishing layer of the pad. When the only movement of the wafer is rotational, the width of the wafer track is equal to the diameter of the wafer. However, in some dual-axis polishers, the wafer is oscillated in a plane perpendicular to its axis of rotation. In this case, the width of the wafer track is wider than the diameter of the wafer by an amount that accounts for the displacement due to the oscillation. The carrier assembly provides a controllable pressure between the wafer and polishing pad. During polishing, a slurry, or other polishing medium, is flowed onto the polishing pad and into the gap between the wafer and polishing layer. The wafer surface is polished and made planar by chemical and mechanical action of the polishing layer and slurry on the surface.

The interaction among polishing layers, polishing media and wafer surfaces during CMP is being increasingly studied in an effort to optimize polishing pad designs. Most of the polishing pad developments over the years have been empirical in nature. Much of the design of polishing surfaces, or layers, of polishing pads has focused on providing these layers with various patterns of voids and/or networks of grooves that are claimed to enhance slurry utilization and polishing uniformity. Over the years, quite a few different groove and void patterns and configurations have been implemented. Prior art groove patterns include radial, concentric circular, Cartesian grid and spiral, among others. Prior art groove configurations include configurations wherein the width and depth of all the grooves are uniform among all grooves and configurations wherein the width or depth of the grooves varies from one groove to another.

Some designers of rotational CMP pads have designed pads having groove configurations that include two or more groove configurations that change from one configuration to another based on one or more radial distances from the center of the pad. These pads are touted as providing superior performance in terms of polishing uniformity and slurry utilization, among other things. For example, in U.S. Pat. No. 6,520,847 to Osterheld et al., Osterheld et al. disclose several pads having three concentric ring-shaped regions, each containing a configuration of grooves that is different from the configurations of the other two regions. The configurations vary in different ways in different embodiments. Ways in which the configurations vary include variations in number, cross-sectional area, spacing and type of grooves.

Although pad designers have heretofore designed CMP pads that include two or more groove configurations that are different from one another in different zones of the polishing layer, these designs do not directly consider the effect of the groove configuration on mixing wakes that occur in the grooves. FIG. 1 shows a plot 10 of the ratio of new slurry to old slurry during polishing at an instant in time within the gap (represented by circular region 14) between a wafer (not shown) and a conventional rotary polishing pad 18 having circular grooves 22. For the purposes of this specification, "new slurry" may be considered slurry that is moving in the rotational direction of polishing pad 18, and "old slurry" may be considered slurry that has already participated in polishing and is being held within the gap by the rotation of the wafer.

In plot 10, new slurry region 26 essentially contains only new slurry and old slurry region 30 essentially contains only old slurry at an instant in time when polishing pad 18 is rotated in direction 34 and the wafer is rotated in direction 38. A mixing region 42 is formed in which new slurry and old slurry become mixed with one another so as to cause a concentration gradient (represented by region 42) between new slurry region 26 and old slurry region 30. Computational fluid dynamics simulations show that due to the rotation of the wafer, slurry immediately adjacent to the wafer may be driven in a direction other than the rotational direction 34 of the pad, whereas slurry somewhat removed from the wafer is held among "asperities" or roughness elements on the surface of polishing pad 18 and more strongly resists being driven in a direction other than direction 34. The effect of wafer rotation is most pronounced at circular grooves 22 at locations where the grooves are parallel, or nearly so, to rotational direction 38 of the wafer because the slurry in the grooves is not held among any asperities and is easily driven by wafer rotation along the length of circular grooves 22. The effect of wafer rotation is less pronounced in circular grooves 22 at locations where the grooves are transverse to rotational direction 38 of the wafer because the slurry can be driven only along the width of the groove within which it is otherwise confined.

Mixing wakes similar to mixing wakes 46 shown occur in groove patterns other than circular patterns, such as the groove patterns mentioned above. Like circular-grooved pad 18 of FIG. 1, in each of these alternative groove patterns, the mixing wakes are most pronounced in regions where the rotational direction of the wafer is most aligned with the grooves, or groove segments, as the case may be, of the pad. Mixing wakes are undesirable in many CMP applications because renewal of active chemical species and removal of heat are slower in the wake region than in the ungrooved areas of the pad immediately adjacent each groove. However, in other applications, mixing wakes can be beneficial precisely because they provide more gradual transitions from spent to fresh chemistry and from warmer to cooler zones of reaction. Without mixing wakes, these transitions can be unfavorably sharp and bring about significant variations in polish conditions point to point under the wafer. Consequently, there is a need for CMP polishing pad designs that are optimized, at least in part, based on the consideration of the occurrence of mixing wakes and the effects that such wakes have on polishing.

STATEMENT OF THE INVENTION

In one aspect of the invention, a polishing pad suitable for polishing at least one of magnetic, optical and semiconductor substrates, comprising: (a) a polishing layer having a polishing region defined by a first boundary corresponding to a trajectory of a first point on a polishing pad and a second boundary defined by a trajectory of a second point on the polishing pad, the second boundary being spaced from the first boundary; (b) at least one first small-angle groove at least partially contained within the polishing region proximate the first boundary and forming an angle of −40° to 40° relative to the first boundary at a point proximate the first boundary; (c) at least one second small-angle groove at least partially contained within the polishing region proximate the second boundary and forming an angle of −40° to 40° relative to the second boundary at a point proximate the second boundary; and (d) a plurality of large-angle grooves, each contained within the polishing region and located between the at least one first small-angle groove and the at least one second small angle groove and each of the plurality of large-angle grooves forming an angle of 45° to 135° relative to each of the first boundary and the second boundary.

In another aspect of the invention, a method of polishing a magnetic, optical or semiconductor substrate, comprising the step of polishing the substrate with a polishing medium and the polishing pad described immediately above.

DETAILED DESCRIPTION OF THE INVENTION

Figure 2:
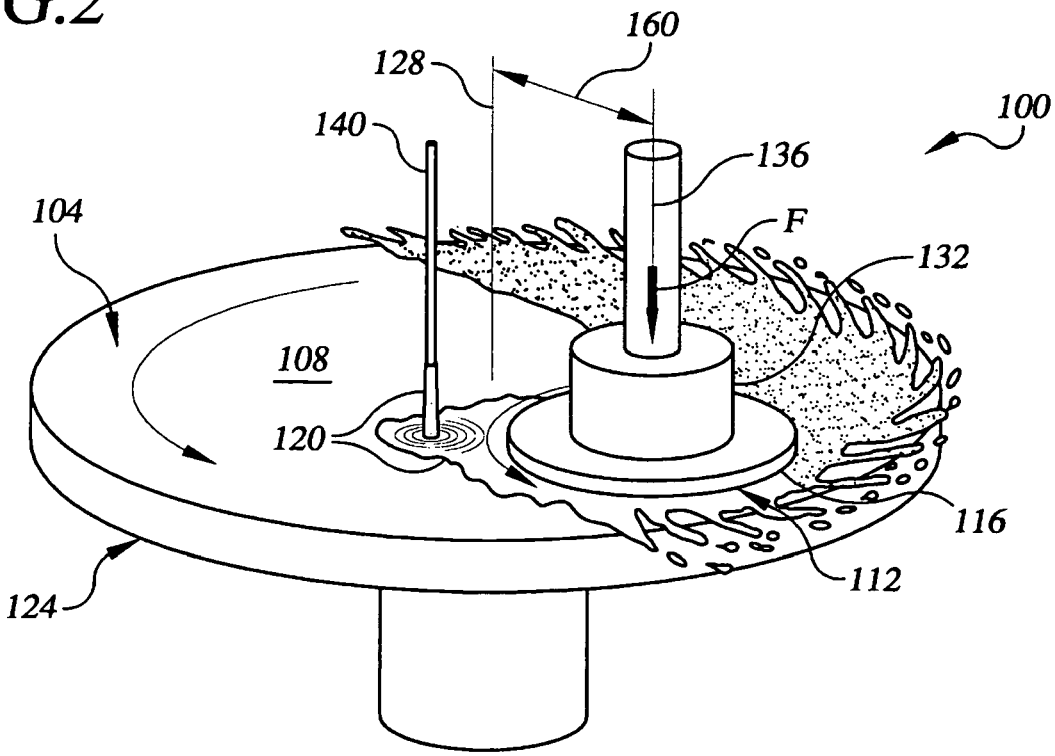
FIG. 2 is a perspective view of a portion of a dual-axis polisher suitable for use with the present invention.

Referring again to the drawings, FIG. 2 generally illustrates the primary features of a dual-axis chemical mechanical polishing (CMP) polisher 100 suitable for use with the present invention. Polisher 100 generally includes a polishing pad 104 having a polishing layer 108 for engaging an article, such as semiconductor wafer 112 (processed or unprocessed) or other workpiece, e.g., glass, flat panel display or magnetic information storage disk, among others, so as to effect polishing of a surface 116 (hereinafter referred to as "polished surface") of the workpiece in the presence of a slurry 120 or other polishing medium. For the sake of convenience, the terms "wafer" and "slurry" are used below without the loss of generality. In addition, as used in this specification, including the claims, the terms "polishing medium" and "slurry" include particle-containing polishing solutions and non-particle-containing solutions, such as abrasive-free and reactive-liquid polishing solutions.

As discussed below in detail, the present invention includes providing polishing pad 104 with a groove arrangement (see, e.g., groove arrangement 144 of FIG. 3A) that enhances the formation of mixing wakes or increases the size of mixing wakes that occur in the gap between wafer 112 and polishing pad 104 during polishing. As discussed in the background section above, mixing wakes occur in the gap where new slurry replaces old slurry and are most pronounced in regions where the rotational direction of wafer 112 is most aligned with the grooves, or groove segments, as the case may be, of polishing pad 104.

Polisher 100 may include a platen 124 on which polishing pad 104 is mounted. Platen 124 is rotatable about a rotational axis 128 by a platen driver (not shown). Wafer 112 may be supported by a wafer carrier 132 that is rotatable about a rotational axis 136 parallel to, and spaced from, rotational axis 128 of platen 124. Wafer carrier 132 may feature a gimbaled linkage (not shown) that allows wafer 112 to assume an aspect very slightly non-parallel to polishing layer 108, in which case rotational axes 128, 136 may be very slightly askew. Wafer 112 includes polished surface 116 that faces polishing layer 108 and is planarized during polishing. Wafer carrier 132 may be supported by a carrier support assembly (not shown) adapted to rotate wafer 112 and provide a downward force F to press polished surface 116 against polishing layer 108 so that a desired pressure exists between the polished surface and the polishing layer during polishing. Polisher 100 may also include a slurry inlet 140 for supplying slurry 120 to polishing layer 108.

As those skilled in the art will appreciate, polisher 100 may include other components (not shown) such as a system controller, slurry storage and dispensing system, heating system, rinsing system and various controls for controlling various aspects of the polishing process, such as: (1) speed controllers and selectors for one or both of the rotational rates of wafer 112 and polishing pad 104; (2) controllers and selectors for varying the rate and location of delivery of slurry 120 to the pad; (3) controllers and selectors for controlling the magnitude of force F applied between the wafer and pad, and (4) controllers, actuators and selectors for controlling the location of rotational axis 136 of the wafer relative to rotational axis 128 of the pad, among others. Those skilled in the art will understand how these components are constructed and implemented such that a detailed explanation of them is not necessary for those skilled in the art to understand and practice the present invention.

During polishing, polishing pad 104 and wafer 112 are rotated about their respective rotational axes 128, 136 and slurry 120 is dispensed from slurry inlet 140 onto the rotating polishing pad. Slurry 120 spreads out over polishing layer 108, including the gap beneath wafer 112 and polishing pad 104. Polishing pad 104 and wafer 112 are typically, but not necessarily, rotated at selected speeds between 0.1 rpm and 150 rpm. Force F is typically, but not necessarily, of a magnitude selected to induce a desired pressure of 0.1 psi to 15 psi (6.9 kPa to 103 kPa) between wafer 112 and polishing pad 104.

Figure 1:
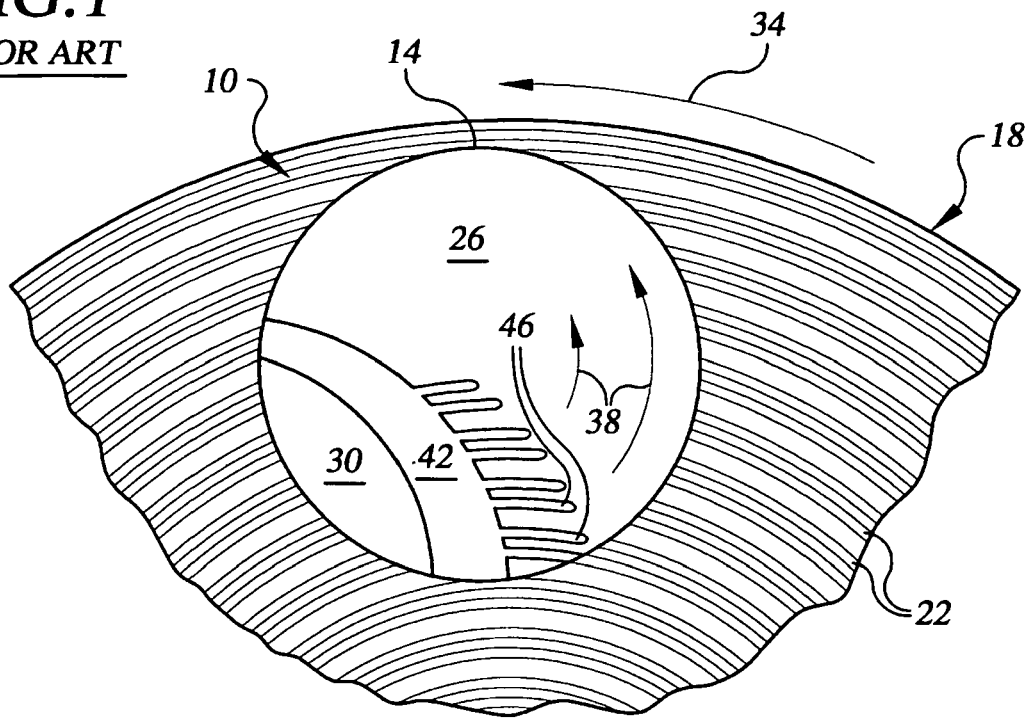
FIG. 1 PRIOR ART
FIG. 1 is a partial plan view/partial plot illustrating the formation of mixing wakes in the gap between a wafer and a prior art polishing pad having a circular groove pattern.
Figure 3A:
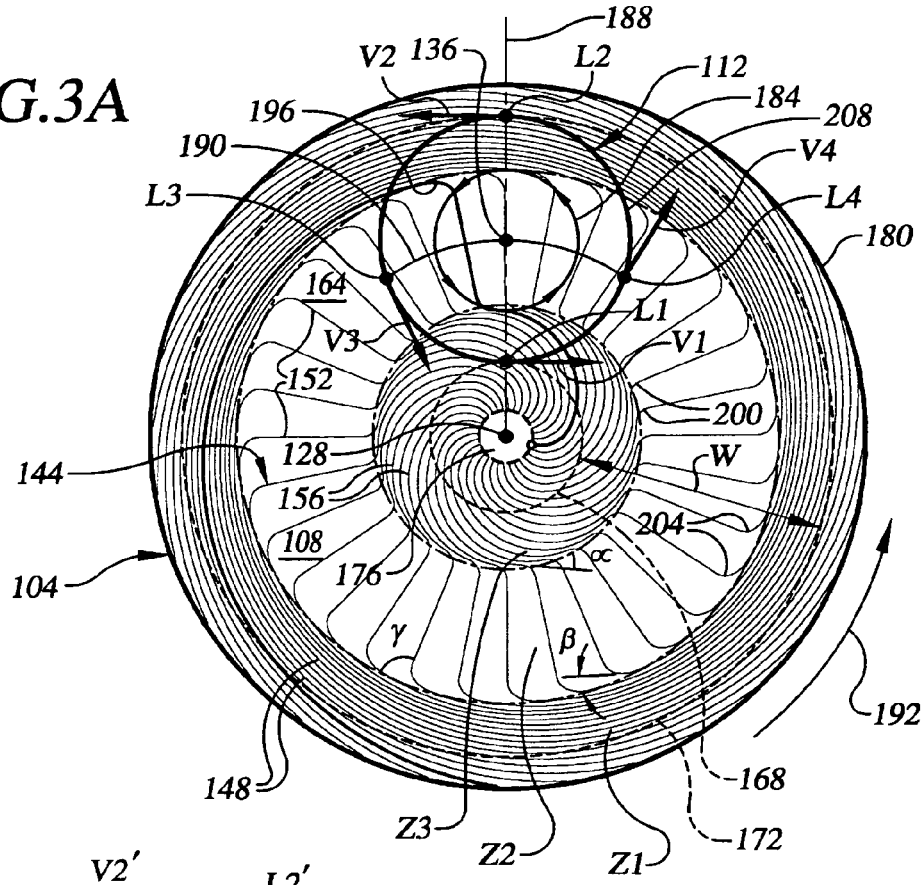
FIG. 3A is a plan view of a rotary polishing pad of the present invention.

FIG. 3A illustrates in connection with polishing pad 104 of FIG. 2, a groove arrangement 144 that, as mentioned above, enhances the formation of mixing wakes (elements 46 of FIG. 1) or increases the size of mixing wakes within grooves 148, 152, 156 present in polishing layer 108 of the pad. Generally, the concept underlying the present invention is to provide grooves 148, 152, 156 that are parallel, or nearly so, to the tangential velocity vectors of wafer 112 at all locations on polishing layer 108, or at as many locations as possible or practicable. If rotational axis 136 of wafer 112 were coincident with rotational axis 128 of the polishing pad 104, the ideal groove pattern according to the present invention would be one in which the grooves were concentric with the rotational axis of the pad. However, in dual-axis polishers, such as polisher 100 illustrated in FIG. 2, the situation is complicated by the offset 160 between rotational axes 128, 136 of polishing pad 104 and wafer 112.

Nevertheless, it is possible to design a polishing pad, e.g., pad 104, for use with a dual-axis polisher that approximates the ideal groove pattern possible when polishing is performed when rotational axes 136, 128 of wafer 112 and the pad are coincident. As a result of offset 160 (FIG. 1) between rotational axes 128, 136, the act of polishing causes polishing pad 104 to sweep out polishing region 164 (commonly referred to as the "wafer track" in the context of semiconductor wafer planarization) defined by an inner boundary 168 and an outer boundary 172. Generally, polishing region 164 is that portion of polishing layer 108 that confronts the polished surface (not shown) of wafer 112 during polishing as polishing pad 104 is rotated relative to the wafer. In the embodiment shown, polishing pad 104 is designed for use with polisher 100 of FIG. 2, wherein wafer 112 is rotated in a fixed position relative to the pad. Consequently, polishing region 164 is annular in shape and has a width W between inner and outer boundaries 168, 172 that is equal to the diameter of the polished surface of wafer 112. In an embodiment wherein wafer 112 is not only rotated, but also oscillated in a direction parallel to polishing layer 108, polishing region 164 would typically likewise be annular, but width W between inner and outer boundaries 168, 172 would be greater than the diameter of the polished surface of wafer 112 to account for the oscillation envelope. Each of inner and outer boundaries 168, 172 may, in general, be considered as being defined by the trajectory of a corresponding point on polishing pad 104 as the pad is rotated about rotational axis 128. That is, inner boundary 168 may, in general, be considered to be defined by the circular trajectory of a point on polishing layer 108 of polishing pad 104 proximate rotational axis 128, whereas outer boundary 172 may, in general, be considered to be defined by the circular trajectory of a point on the polishing layer distal from rotational axis 128.

Inner boundary 168 of polishing region 164 defines a central region 176 where a slurry (not shown), or other polishing medium, may be provided to polishing pad 104 during polishing. In an embodiment wherein wafer 112 is not only rotated but also oscillated in a direction parallel to polishing layer 108, central region 176 may be exceedingly small if the oscillation envelope extends to, or nearly to, the center of polishing pad 104, in which case the slurry or other polishing medium may be provided to the pad at an off-center location. Outer boundary 172 of polishing region 164 will typically be located radially inward of the outer peripheral edge 180 of polishing pad 104, but may alternatively be coextensive with this edge.

In designing groove pattern 144 in a manner that maximizes the number of locations where rotational direction 184 of wafer 112 is aligned with grooves 148, 152, 156 or segments thereof, it is useful to consider the velocity of the wafer at four locations L1, L2, L3, L4, two along a line 188 extending through rotational axes 128, 136 of polishing pad 104 and the wafer, and two along a circular arc 190 concentric with the rotational axis of the pad and extending through the rotational axis of the wafer. This is so because these locations represent four velocity vector extremes of wafer 112 relative to the rotational direction 192 of polishing pad 104. That is, location L1 represents the location where a velocity vector V1 of wafer 112 is essentially directly opposite rotational direction 192 of polishing pad 104 and has the greatest magnitude in this direction, location L2 represents the location where a velocity vector V2 of the wafer is essentially in the same direction as the rotational direction of the pad and has the greatest magnitude in this direction, and locations L3 and L4 represent the locations where respective velocity vectors V3 and V4 of the wafer are essentially perpendicular to the rotational direction of the pad and have the greatest magnitude in such directions. It is at locations L1–L4 that principles underlying the present invention may be applied so as to approximate the ideal groove pattern discussed above.

As can be easily appreciated, consideration of velocity vectors V1–V4 of wafer 112 at these four locations L1–L4 generally leads to the partitioning of polishing region 164 into three zones, zone Z1 corresponding to location L2, zone Z2 corresponding to both locations L3 and L4 and zone Z3 corresponding to location L1. Width W of polishing region 164 may be apportioned among zones Z1–Z3 generally in any manner desired. For example, zones Z1 and Z3 may each be allotted one-quarter of width W and zone Z2 may be allotted one-half of width W. Other apportionment, such as one-third W may be allotted to each of zones Z1, Z2 and Z3, respectively, among others.

Applying the underlying principles of the present invention, i.e., providing grooves 148, 152, 156 that are parallel, or nearly parallel, to velocity vectors V1–V4, to zone Z1 based upon the velocity vector at location L2, shows that grooves 148 are desirably circumferential, or nearly so, in zone Z1. This is so because velocity vector V2 would be parallel to grooves 148 when they have a circumferential, i.e. circular, configuration It is noted that grooves 148 need not be truly circular. Rather, each groove 148 may form an angle β with outer boundary 172 or a line concentric therewith. Generally, angle β is preferably in the range of −40° to +40° and, more preferably within the range of −30° to +30°, and even more preferably within the range of −15° to +15°. In addition, it is noted that each groove 148 need not have a smooth, continuous curvature within zone Z1, but rather may be straight, zigzag, wavy or sawtooth-shaped, among others. Generally, for each groove 148 that is zigzag, wavy, sawtooth-shaped and the like, angle β can be measured from a line that generally represents the transverse center of gravity of that groove.

The requirements for zone Z3 relative to grooves 156 are essentially the same as the requirements for zone Z1, the primary difference being that velocity vector V1 at location L1 is opposite velocity vector V2 at location L2. Accordingly, grooves 156 may be circumferential like grooves 148 of zone Z1 so as to be parallel to inner boundary 168. Also like grooves 148, grooves 156 need not be truly circumferential, but rather may form a non-zero angle α with inner boundary 168 or a line concentric therewith. Generally, angle α is preferably in the range of −40° to +40° and, more preferably within the range of −30° to +30°, and even more preferably within the range of −15° to +15°. Each groove 156 may, if desired, extend from polishing region 164 to a point coincident with rotational axis 128 or a point adjacent thereto, e.g., to aid in the distribution of a polishing medium when the polishing medium is applied to polishing pad 104 proximate its center. In addition, like grooves 148, each groove 156 need not form a smooth and continuous curve, but rather may be straight, zigzag, wavy or sawtooth-shaped, among others. Also like grooves 148, for each groove 156 having a zigzag, wavy, sawtooth-shape or like shape, angle α can be measured from a line that generally represents the transverse center of gravity of that groove.

Velocity vectors V3 and V4 of wafer 112 in zone Z2 are perpendicular to velocity vectors V1 and V2 in zones Z3 and Z1, respectively. In order to make grooves 152 in zone Z2 parallel, or nearly so, to velocity vectors V3 and V4, these grooves may be perpendicular, or substantially perpendicular, to inner and outer boundaries 168, 172 of polishing region 164, i.e., radial or nearly radial relative to rotational axis of polishing pad 104. In this connection, each groove 152 preferably forms an angle γ with either inner boundary 168 or outer boundary 172 of preferably 45° to 135°, more preferably 60° to 120° and even more preferably 75° to 105°.

Corresponding respective ones of grooves 148, grooves 152 and grooves 156 may, but need not, be connected with one another as shown so as to form continuous channels (one of which is highlighted in FIG. 3A and identified by element numeral 196) extending from a location proximate rotational axis 128 and through and beyond polishing region 164. Providing continuous channels 196 as shown can be beneficial to slurry utilization and aid in the flushing of polish debris and removal of heat. Each groove 148 may be connected to a corresponding respective one of grooves 152 at a first transition 200 and, likewise, each groove 152 may be connected to a corresponding respective one of grooves 156 at a second transition 204. Each of first and second transitions 200, 204 may be gradual, e.g., the curved transitions shown, or abrupt, e.g., where the connected ones of grooves 148, 152, 156 form a sharp angle with one another, as desired to suit a particular design.

Although polishing region 164 has been described as being partitioned into three zones Z1–Z3, those skilled in the art will readily appreciate that the polishing region may be portioned into a greater number of zones if desired. However, regardless of the number of zones provided, the process of laying out the grooves, e.g., grooves 148, 152, 156, in each zone may be essentially the same as the process described above relative to zones Z1–Z3. That is, in each of the zones at issue the orientation(s) of the grooves therein may be selected to be parallel, or nearly so, to a wafer velocity vector (similar to velocity vectors V1–V4) at a corresponding location (similar to locations L1–L4).

For example, two additional zones (not shown), one between zones Z1 and Z2 and one between zones Z2 and Z3, may be added as follows. Four additional locations corresponding to four additional velocity vectors may first be determined using two additional circular arcs (each similar to circular arc 190) that are each concentric with rotational axis 128 of polishing pad 104. One of the additional arcs may be located so as to intersect line 188 midway between location L1 and rotational axis 136 of wafer 112 and the other may be located so as to intersect line 188 midway between the rotational axis of the wafer and location L2. The additional locations for the velocity vectors could then be selected to be the four points where the two new circular arcs intersect outer peripheral edge 208 of wafer 112. The two additional zones would then correspond to the two additional circular arcs in a manner similar to the correspondence of zone Z2 to circular arc 190 and corresponding locations L3 and L4. The additional velocity vectors of wafer 112 could then be determined for the four additional locations and new grooves oriented relative to the additional velocity vectors as discussed above relative to grooves 148, 152, 156.

Figure 3B:
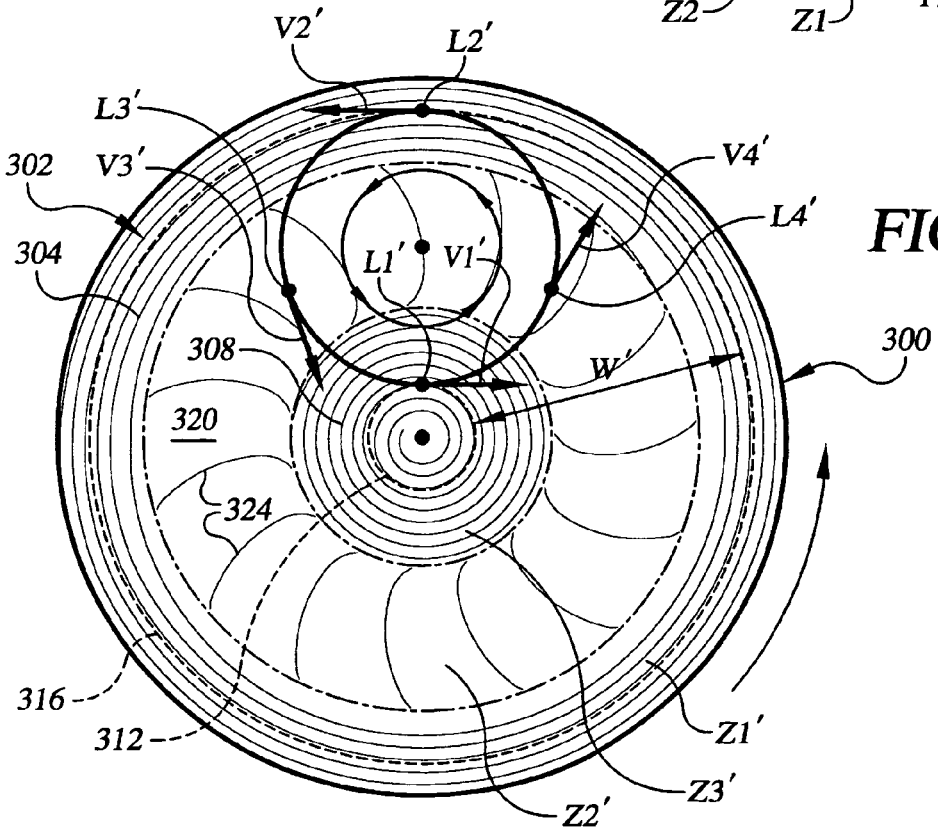
FIG. 3B is a plan view of an alternative rotary polishing pad of the present invention.
Figure 3C:
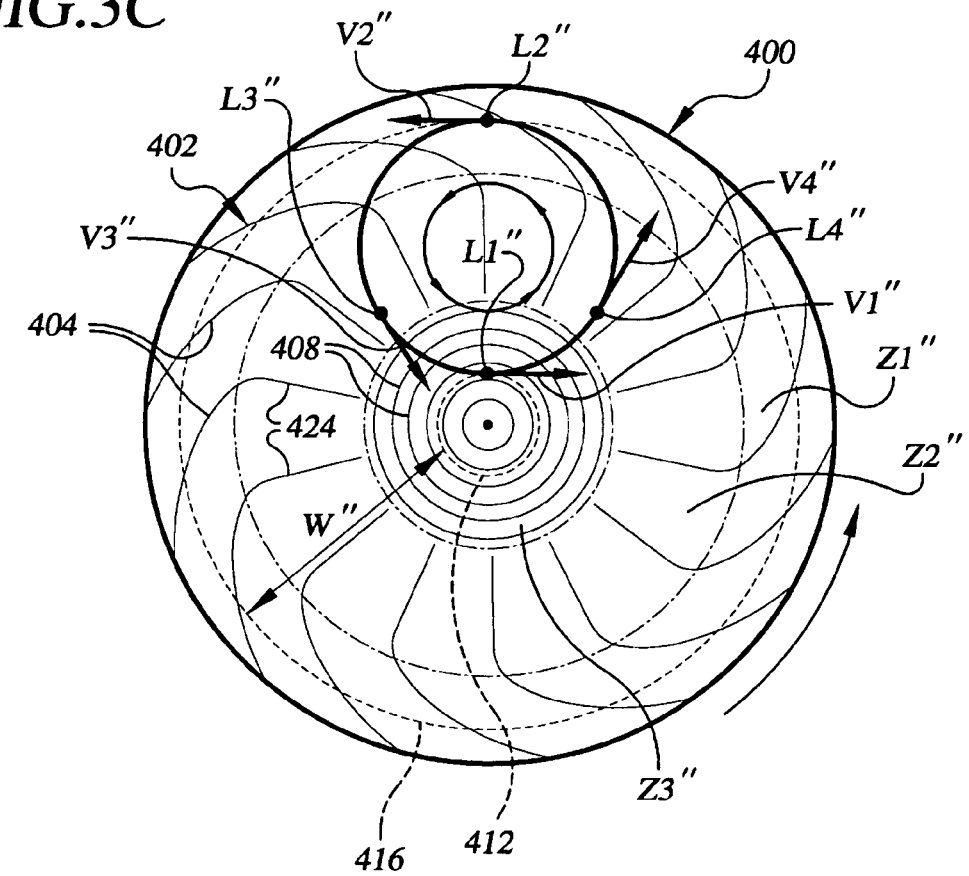
FIG. 3C is a plan view of another alternative rotary polishing pad of the present invention.

FIGS. 3B and 3C each show a polishing pad 300, 400 each having a groove pattern 302, 402 that is generally a variation on groove pattern 144 of FIG. 3A that captures the underlying concepts of the present invention. FIG. 3B shows zones Z1' and Z3' as each partially containing a single groove 304, 308, respectively, that is generally spiral and substantially parallel to the corresponding one of inner and outer boundaries 312, 316 of polishing region 320. Of course, grooves 304, 308 may have other shapes and orientations, such as the shapes and orientations discussed above in connection with FIG. 3A. FIG. 3B also shows zone Z2' as containing a plurality of generally radial, curved grooves 324, wherein at any point therealong, each groove is largely perpendicular to inner and outer boundaries 312, 316 (and also largely perpendicular to grooves 304, 308). It can be readily seen that groove pattern 302 provides, in accordance with the present invention, groove 304 that is substantially parallel to velocity vector V1', groove 308 that is substantially parallel to velocity vector V2' and grooves 324 that are substantially parallel to velocity vectors V3' and V4', so as to enhance the formation and extent of mixing wakes that form in zones Z1'–Z3' during polishing. Width W' may be apportioned among zones Z1'–Z3' in any suitable manner, such as one-quarter W'/one-half W'/one-quarter W' or one-third W' to each, among others.

It is noted that, depending upon the configuration of grooves 304, 308 in zone Z1' and zone Z3', respectively, one or more additional grooves may be added to these zones so as to cross corresponding respective grooves 304, 308. This can be readily envisioned in the context of spiral grooves 304, 308 of FIG. 3B. For example, in addition to counterclockwise spiral grooves 304, 308 shown, each of zones Z1' and Z3' may also contain a similar clockwise spiral groove (not shown), that must necessarily cross the counterclockwise spiral groove at many locations.

FIG. 3C shows zone Z1" as containing a plurality of grooves 404 that are substantially spiral in shape relative to polishing pad 400. This configuration of grooves 404 enhances the establishment and extent of mixing wakes within zone Z1" in a manner similar to grooves 148 of FIG. 3A. Also, FIG. 3C shows zone Z3" as containing grooves 408 that are ring-shaped and concentric relative to polishing pad 400. Like the spiral configuration of grooves 404 enhances the ability of mixing wakes to form therein in zone Z1", the circular configuration of grooves 408 enhances the ability of mixing wakes to form therein in zone Z3". Of course, grooves 404, 408 may have other shapes and orientations, such as the shapes and orientations discussed above in connection with FIG. 3A.

FIG. 3C further shows zone Z2" as containing a plurality of radial grooves 424 that are each largely perpendicular to inner and outer boundaries 412, 416. As in FIGS. 3A and 3B, it can be readily seen that groove pattern 402 provides, in accordance with the present invention, grooves 408 that are substantially parallel to velocity vector V1", grooves 404 that are substantially parallel to velocity vector V2" and grooves 424 that are substantially parallel to velocity vectors V3" and V4", so as to enhance the formation and extent of mixing wakes that form in these grooves during polishing. Width W" may be apportioned among zones Z1"–Z3" in any suitable manner, such as one-quarter W"/one-half W"/one-quarter W" or one-third W" to each, among others.

Figure 4:
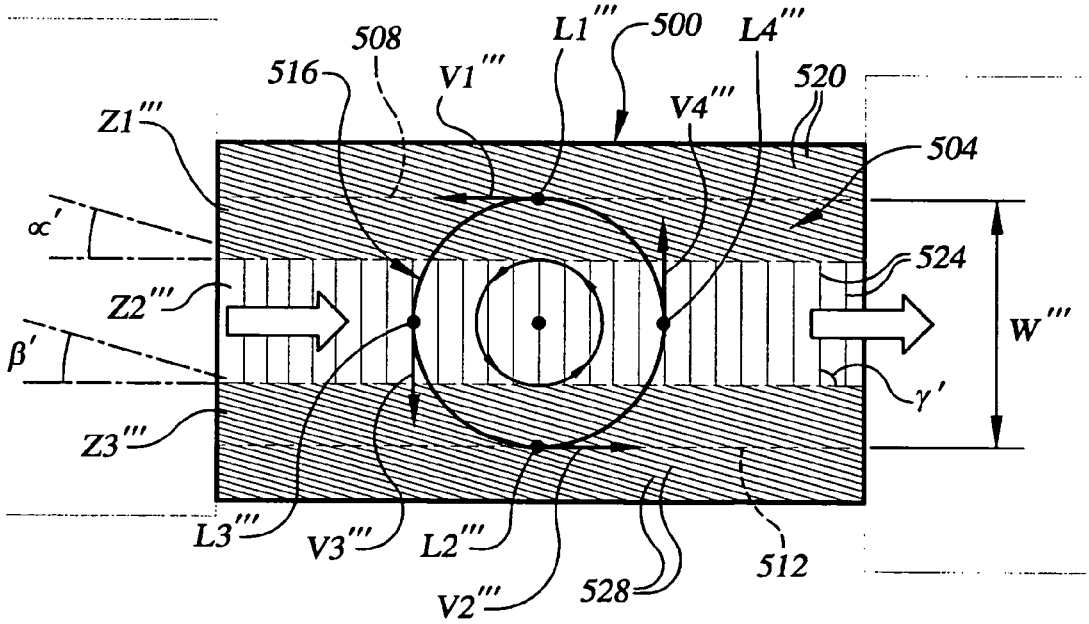
FIG. 4 is a partial plan view of a belt-type polishing pad of the present invention.

FIG. 4 illustrates the present invention in the context of a continuous belt-type polishing pad 500. Like rotary polishing pads 104, 300, 400 discussed above in connection with FIGS. 3A–3C, polishing pad 500 of FIG. 4 includes a polishing region 504 defined by a first boundary 508 and a second boundary 512 spaced from one another by a distance W'" equal to or greater than the diameter of the polished surface (not shown) of wafer 516, depending upon whether or not the wafer is oscillated in addition to rotated during polishing. Also similar to rotary polishing pads 104, 300, 400, polishing region 504 may be partitioned into three zones Z1'", Z2'" and Z3'" containing corresponding grooves 520, 524, 528 having orientations or orientations and shapes selected based on the direction of certain ones of the velocity vectors of wafer 516, such as velocity vectors V1'", V2'", V3'" and V4'" located, respectively, at locations L1'", L2'", L3'" and L4'". Width W'" of polishing region 504 may be apportioned to zones Z1'", Z2'" and Z3'" in the manner discussed above relative to FIG. 3A.

Other than the shape of polishing region 504 being different from the shape of polishing region 164 of FIG. 3A (linear as opposed to circular) and the locations L3'" and L4'" of FIG. 4 being different from locations L3 and L4 of FIG. 3A in a similar manner, the principles underlying the selection of the orientations of grooves 520, 524, 528 is essentially the same as discussed above relative to FIG. 3A. That is, it is desirable that grooves 520 in zone Z1'" be parallel, or nearly so, to velocity vector V1'", grooves 524 in zone Z2'" be parallel, or nearly so, to velocity vectors V3'" and V4'" and grooves 528 in zone Z3'" be parallel, or nearly so, to velocity vector V2'". These desires may be satisfied in the same manner as discussed above relative to rotary polishing pads 104, 300, 400, i.e., by making grooves 520 parallel, or substantially parallel to first boundary 508 of polishing region 504, making grooves 524 perpendicular, or substantially perpendicular to, first and second boundaries 508, 512 and making grooves 528 parallel, or substantially parallel, to second boundary 512.

Generally, these goals may be satisfied by making grooves 520 form an angle $\alpha'$ with first boundary 508 of about −40° to +40°, more preferably within the range of −30° to +30°, and even more preferably within the range of −15° to +15°, making grooves 524 form an angle $\gamma'$ with first or second boundary 508, 512 of about 45° to 135°, more preferably 60° to 120° and even more preferably 75° to 105°, and making grooves 528 form an angle $\beta'$ with second boundary 512 of about −40° to +40°, more preferably within the range of −30° to +30°, and even more preferably within the range of −15° to +15°. It is noted that although grooves 520, 524, 528 are connected to one another so as to form continuous channels, this need not be so. Rather grooves 520, 524, 528 may be discontinuous relative to one another, e.g., in the manner of grooves 424 of FIG. 3C. Translating radial grooves 424 of FIG. 3C to belt-type polishing pad 500 of FIG. 4, grooves 524 in zone Z2'" would be linear and perpendicular to first and second boundaries 508, 512. However, if grooves 520, 524, 528 are connected to one another, transitions may be abrupt (as shown) or more gradual, e.g., similar to first and second transitions 200, 204 of FIG. 3A.

What is claimed is:

1. A polishing pad suitable for polishing at least one of magnetic, optical and semiconductor substrates, comprising:

(a) a polishing layer having a polishing region defined by a first boundary corresponding to a trajectory of a first point on the polishing pad and a second boundary defined by a trajectory of a second point on the polishing pad, the second boundary being spaced from the first boundary, a first zone proximate the second boundary, a second zone between the second boundary and the first boundary, and a third zone proximate the first boundary;

(b) at least one first small-angle groove at least partially contained within the polishing region proximate the first boundary and forming an angle of −40° to 40° relative to the first boundary at a point proximate the first boundary and in the third zone;

(c) at least one second small-angle groove at least partially contained within the polishing region proximate the second boundary and forming an angle of −40° to 40° relative to the second boundary at a point proximate the second boundary and in the first zone; and (d) a plurality of large-angle grooves, each contained within the polishing region and located between the at least one first small-angle groove and the at least one second small angle groove and each of the plurality of large-angle grooves forming an angle of 45° to 135° relative to each of the first boundary and the second boundary, and in the second zone.

2. The polishing pad according to claim 1, wherein the polishing pad is a rotary polishing pad rotatable about a rotational axis.

3. The polishing pad according to claim 2, wherein each of the at least one first small-angle groove and the at least one second small-angle groove is a spiral groove.

4. The polishing pad according to claim 2, wherein each of the plurality of large-angle grooves is radial relative to the rotational axis of the rotary polishing pad.

5. The polishing pad according to claim 1, further comprising a plurality of first small-angle grooves, wherein each of the plurality of first small-angle grooves connects to a corresponding respective one of the plurality of large-angle grooves.

6. The polishing pad according to claim 5, further comprising a plurality of second small-angle grooves, wherein each one of the plurality of large angle grooves connects at a first end to a corresponding respective one of the plurality of first small-angle grooves and connects at a second end to a corresponding respective one of the plurality of second small-angle grooves.

7. The polishing pad according to claim 1, wherein the polishing pad is a linear belt.

8. The polishing pad of claim 1, wherein the plurality of large-angle grooves form an angle of 60° to 120° relative to each of the first boundary and the second boundary, and in the second zone.

9. A method of polishing a magnetic, optical or semiconductor substrate, comprising the step of polishing the substrate with a polishing medium and the polishing pad of claim 1.

10. The method according to claim 9, wherein the polishing pad polishes a semiconductor wafer and the at least one first small-angle groove, the at least one second small-angle groove and the plurality of large-angle grooves are adjacent the semiconductor wafer simultaneously for at least a portion of the polishing.

* * * * *